US006053244A

United States Patent [19]

Dybevik et al.

[11] Patent Number: 6,053,244

[45] Date of Patent: Apr. 25, 2000

[54] RELEASE MECHANISM

[75] Inventors: Arthur Hrrman Dybevik, Sandnes; Tarald Gudmestad, Naerbo, both of Norway

[73] Assignee: Weatherford/Lamb, Inc., Houston, Tex.

[21] Appl. No.: 09/101,259

[22] PCT Filed: Jan. 3, 1997

[86] PCT No.: PCT/GB97/00015

§ 371 Date: Oct. 28, 1998

§ 102(e) Date: Oct. 28, 1998

[87] PCT Pub. No.: WO97/25515

PCT Pub. Date: Jul. 17, 1997

[30] Foreign Application Priority Data

Jan. 4, 1996 [GB] United Kingdom ..... 9600103
Aug. 27, 1996 [GB] United Kingdom ..... 9617820

[51] Int. Cl.[7] ..... E21B 23/00

[52] U.S. Cl. ..... 166/208; 166/240

[58] Field of Search ..... 166/208, 215, 166/381, 382, 240, 125

[56] References Cited

U.S. PATENT DOCUMENTS

| | | | |
|---|---|---|---|
| 1,866,087 | 7/1932 | Crowell . | |
| 3,291,220 | 12/1966 | Mott . | |
| 3,516,703 | 6/1970 | Templeton . | |
| 3,999,604 | 12/1976 | Amancharla et al. | 166/206 |
| 4,067,388 | 1/1978 | Mouret et al. | 166/208 |
| 4,256,179 | 3/1981 | Shillander | 166/237 |
| 4,273,464 | 6/1981 | Scott | 166/240 X |
| 4,496,000 | 1/1985 | Weeks | 166/382 |
| 4,562,889 | 1/1986 | Braddick | 166/381 |
| 4,690,220 | 9/1987 | Braddick | 166/382 |
| 4,768,588 | 9/1988 | Kupsa | 166/55 |
| 4,982,795 | 1/1991 | King | 166/382 |
| 5,010,955 | 4/1991 | Springer | 166/240 X |
| 5,086,843 | 2/1992 | Mims et al. | 166/380 |
| 5,154,231 | 10/1992 | Bailey et al. | 166/298 |
| 5,311,941 | 5/1994 | Baugh | 166/208 |
| 5,595,247 | 1/1997 | Braddick | 166/297 |
| 5,636,689 | 6/1997 | Rubbo et al. | 166/123 |

OTHER PUBLICATIONS

TIW General Catalog, 1994–95.

*Primary Examiner*—Frank Tsay
*Attorney, Agent, or Firm*—Guy McClung

[57] ABSTRACT

A tool can be released from a tool string in a wellbore by setting the tool and applying reverse torque to the tool string for an extended period. The release mechanism (200) comprises a latch (250) including a plurality of collects (253) which are held in a radially extended position to secure a tool "T" to the tool string. A first member (201) is connected to the tool string and to the latch (250). A second member (202) is connected to the latch. In use, after the tool is set reverse torque is applied to the first member (201) to rotate it relative to the second member (202) which is constrained against rotation by the action of the tool on the latch. When the first member (201) has rotated sufficiently the first and second members occupy a release position in which downward movement of the first member (201) relative to the second member (202) (which was previously blocked) is permitted. This movement releases the latch (250) and hence allows separation of the tool and the tool string. In order to prevent accidental release relative movement between the first member (201) and second member (202) is inhibited by providing both members with vanes (204, 208) and filling the chamber therebetween with hydraulic fluid. The damping is preferably arranged so that a significant reverse torque, for example 3500 ft/lbs must be applied for a prolonged period, for example 30 seconds, before the latch can be released.

11 Claims, 6 Drawing Sheets

250
251
254
255
253
257
258
262
256
260
263
259
261
T
252

RELEASE MECHANISM

BACKGROUND OF THE INVENTION

This invention relates to a release mechanism and, more particularly but not exclusively, is concerned with a release mechanism for enabling a tool to be detached from a tool string during the construction, maintenance and repair of oil and gas wells.

During the construction, maintenance and repair of oil and gas wells it is frequently necessary to locate a tool at a given position in the wellbore. This is typically achieved by lowering the tool on the end of a tool string until the tool reaches the desired position. The tool is then secured in place. The tool is then separated from the tool string which is withdrawn from the wellbore.

A large number of release mechanisms are used to facilitate the separation of the tool string from the tool. One release mechanism is generally referred to as a "J-slot". In particular, after the tool has been secured in place the tool string is lowered by a small distance relative to the tool, rotated (typically through 30°), and then raised to effect separation. Another release mechanism comprises a long coarse left hand threaded joint. Other release mechanisms include a valve seat. When it is desired to release the tool from the tool string an actuator such as a ball or dart is released down the wellbore. The actuator comes to rest on the valve seat. Pressure is then applied to the actuator and this is utilised to release the tool.

Whilst these release mechanisms are generally acceptable they occasionally fail which can cause serious delays. As a result of these failures it is now common for oil companies to require a contractor to provide a tool with a secondary release mechanism in case the primary release mechanism fails.

One secondary release mechanism which is commonly used comprises a shear pin which is not subject to stress when the tool string is rotated in its usual sense ("right hand torque") but which is subject to stress and can be sheared when the tool string is rotated in the opposite sense ("left hand torque"). The problem with this arrangement is that the shear pin can be inadvertently sheared during normal operations, for example if the tool is being rotated and the top drive stalls the torsional energy stored in the tool string may cause the tool string to spin anti-clockwise generating an inertia in the tool string which may cause the tool string to rotate anti-clockwise relative to the tool and sheer the shear pin. Furthermore, if the top drive stalls the inertia of the tool itself may cause the tool to rotate relative to the tool string and shear the shear pin. This problem is particularly acute when the tool is used for supporting a liner which needs to be rotated prior to cementing. In this case the inertia is influenced by the combined weight of the liner and tool.

Typically unplanned disconnections are caused by relatively intense forces of short duration.

The aim of the present invention is to provide a release mechanism which is less susceptible to release by such forces and which, whilst primarily intended as a secondary release mechanism could also be used as a primary release mechanism.

SUMMARY OF THE INVENTION

According to the present invention there is provided a release mechanism for releasing a tool from a tool string during the construction, maintenance and repair of oil and gas wells, which release mechanism comprises a latch for releasably securing said tool to said tool string, a first member connectable to said tool string and connected to said latch and a second member connected to said latch, said first member being rotatable relative to said second member when said tool is set to a release position in which said latch is released or can be released by displacement of said tool string into or out of said well, characterised in that said release mechanism comprises means to damp said relative rotation between said first member and said second member.

Preferably, said means comprises at least one vane on said first member, at least one vane on said second member and hydraulic fluid therebetween.

The degree of damping required will depend on a number of factors. However, since the release mechanism is primarily intended as a backup for use in the event that the primary release mechanism fails it is anticipated that the damping should be relatively heavy, for example requiring a torque of 3500 ft/lbs to be applied for at least 30 seconds to move the first member and second member into the release position.

At least one of the vanes may be formed by, for example removing metal from the solid or by fixing, for example welding and/or bolting and/or gluing, bars to the inner surface of a cylinder and/or the outer surface of a shaft.

The vanes may be of generally rectangular form or of any convenient shape.

In one embodiment the vanes are generally elongate and are rounded at their ends. The vanes are preferably provided with an external circumferentially extending groove which can accommodate a resilient sealing member, for example an "O"-ring. The first member and the second member are preferably shaped to accommodate the vanes therebetween and a removable section is preferably provided to facilitate assembly of said release mechanism.

The first member and the second member are preferably provided with one or more seals to inhibit the flow of hydraulic fluid from said release mechanism.

Advantageously, a seal is provided at the Juncture of said first member and said second member in a position where it is also in contact with said vanes.

According to the degree of damping required at least one of the vanes may be provided with an orifice of a desired size. Alternatively, it may be possible to simply rely on seepage past the seals.

Preferably the release mechanism will also be provided with at least one port through which hydraulic fluid can be introduced. Such ports may either be fitted with a non-release valve or simply plugged after sufficient hydraulic fluid has been introduced.

Preferably said release mechanism further comprises a shear pin which will, in use, be fractured when said first member and second member reach their release position and will thereafter permit separation of said tool and said tool string.

The hydraulic fluid may comprise an oil or a grease.

BRIEF DESCRIPTION OF THE INVENTION

For a better understanding of the present invention reference will now be made, by way of example, to the accompanying drawings, in which.

DETAILED DESCRIPTION OF PREFERRED EMBODIMENTS

Figure 1:
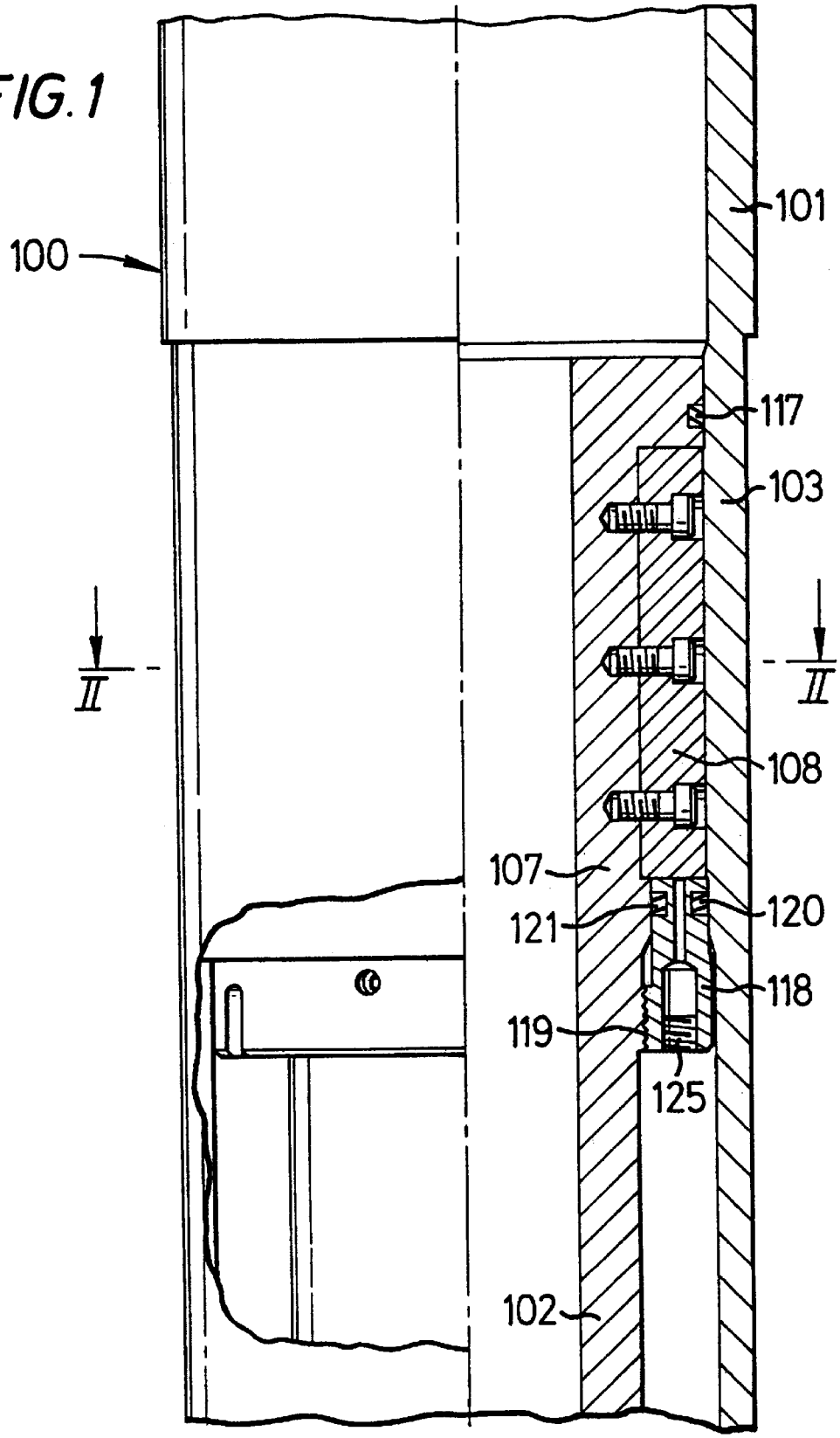
FIG. 1 is a side view, partly in section and partly cut-away, of part of one embodiment of a release mechanism according to the present invention.
Figure 2:
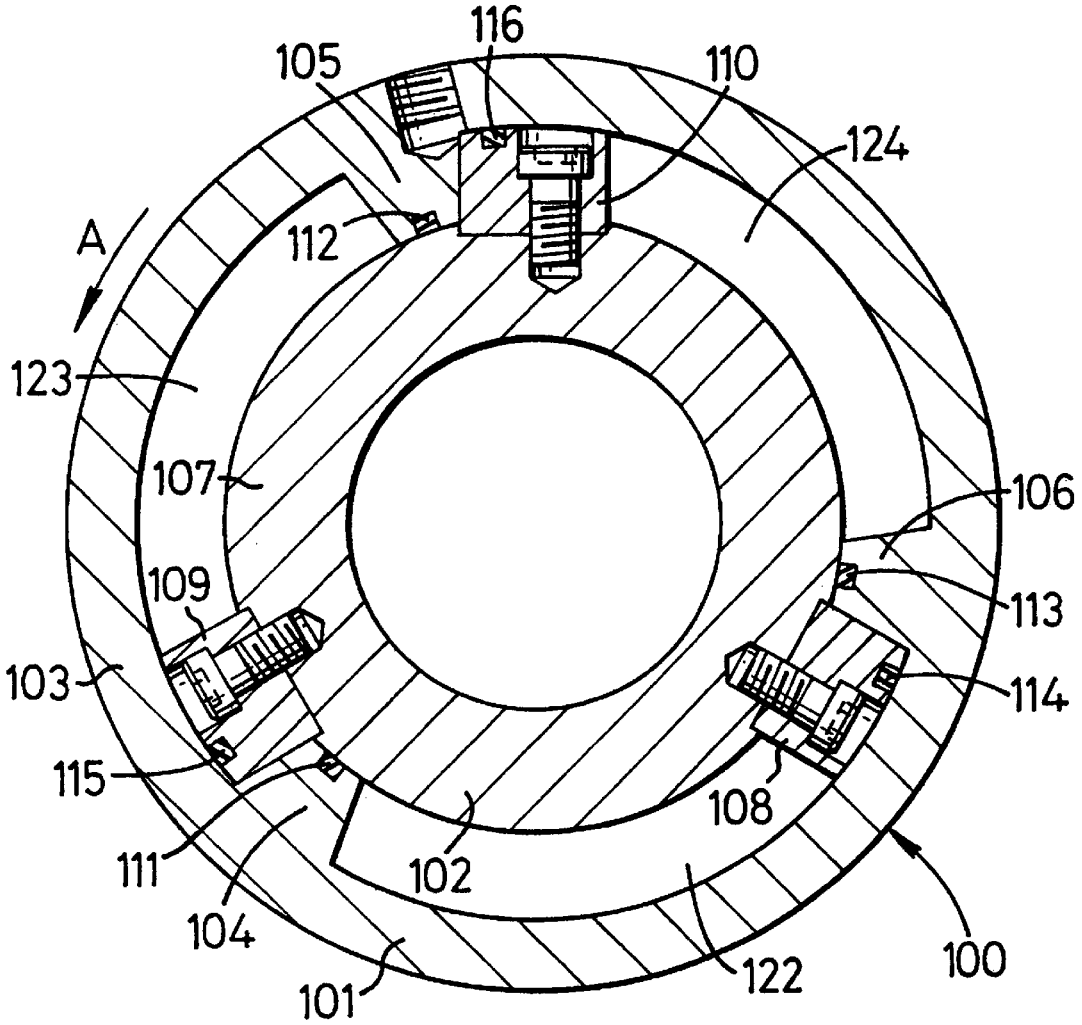
FIG. 2 is a section taken on line II—II of FIG. 1 with parts omitted for clarity.

Referring to FIGS. 1 and 2 there is shown part of a release mechanism which is generally identified by the reference numeral 100.

The release mechanism 100 comprises a first member 101 the left hand end of which can be connected to a tool string (not shown) and the right hand end to part of a latch (not shown), The release mechanism 100 also comprises a second member 102 which can be connected to the latch.

The first member 101 comprises a cylinder 103 provided with three vanes 104, 105 and 106 which project radially inwardly. The vanes 104, 105 and 106 are formed by removing metal from the cylinder 103.

The second member 102 comprises a shaft 107 having three vanes 108, 109 and 110 extending radially outwardly therefrom. Each of the vanes 108, 109 and 110 are secured to the shaft 107 by three bolts.

Each of the vanes 104, 105 and 106 is provided with a longitudinally extending seal 111, 112, 113 respectively which engages the outer surface of the shaft 107 whilst the vanes 108, 109, 110 are each provided with a longitudinally extending seal 114, 115, 116 respectively which engages the first member 101.

As can be seen in FIG. 1 the left hand end of the second member 102 is provided with a circumferentially extended seal 117 which engages the inner surface of the first member 101.

A removable section 118 is threadedly connected to the second member 102 by threads 119 and is provided with circumferentially extending grooves which accommodate circumferentially extending "O"-rings 120 and 121 which seal against the first member 101 and the second member 102 respectively.

The vanes 108, 104; 109, 105; 110, 106 each define a chamber 122, 123, 124 therebetween which is filled with hydraulic fluid via three ports only one of which, port 125, is visible in FIG. 1. Each port is fitted with a check valve (not shown).

In operation the first member 101 is connected to the bottom of a tool string. The tool is then lowered down a wellbore to the required depth and set.

Setting generally involves causing part of the tool to expand against the inside of the wellbore or casing. Setting may be effected by, for example, an inflatable packer, or more usually, jaws. Means may be provided to prevent the jaws returning to their original position on a permanent or temporary basis. The tool may comprise, for example a whipstock or a liner hanger.

Once the tool is set the tool string may be disconnected and retrieved. This is usually effected by unlatching a J-slot connection or releasing an actuator ball as described hereinbefore. However, if this fails an anti-clockwise turning movement is applied to the tool string. This tends to turn the first member 101 in the direction of the arrow "A" in FIG. 2.

This motion causes the hydraulic fluid in chambers 122, 123 and 124 to become pressurized since second member 102 is held fast against rotation by the tool acting through the latch.

It will be appreciated from FIG. 1 that there is a small passage between each end of each longitudinally extending seal 111, 112, 113, 114, 115 and 116 and each circumferentially extending seal 117, 120 and 121. These small passages permit a low flow of hydraulic fluid so that if sufficient torque is applied for sufficient time the vanes 104, 108; 105, 109; 106, 110 will come into proximity. In the embodiment described this happens after about 30 seconds when an anti-clockwise torque of 3500 ft/lbs is applied to the first member 101. In this connection it will be noted that when clockwise torque is applied to the member 101 when it is in the position shown in FIG. 2 this will simply be transferred to the second member 102 although this could be avoided by arranging to transmit the torque directly from the first member 101 to the second member 102.

The relative movement between the first member 101 and the second member 102 is used to release the tool from the tool string either directly or indirectly, for example by releasing the latch directly or permitting movement which was previously blocked to release the latch.

Figure 3:
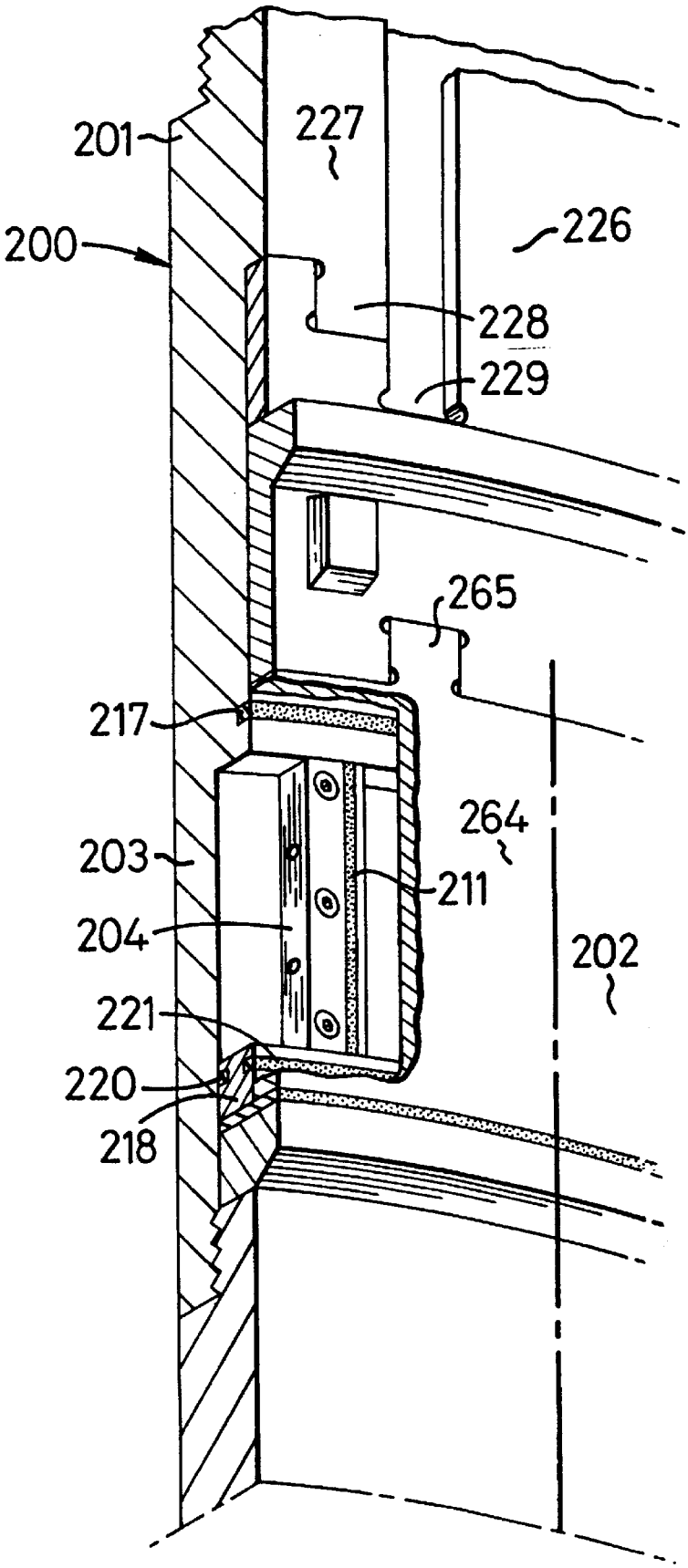
FIG. 3 is a sketch of the top part of a second embodiment of a release mechanism according to the present invention in use.
Figure 4:
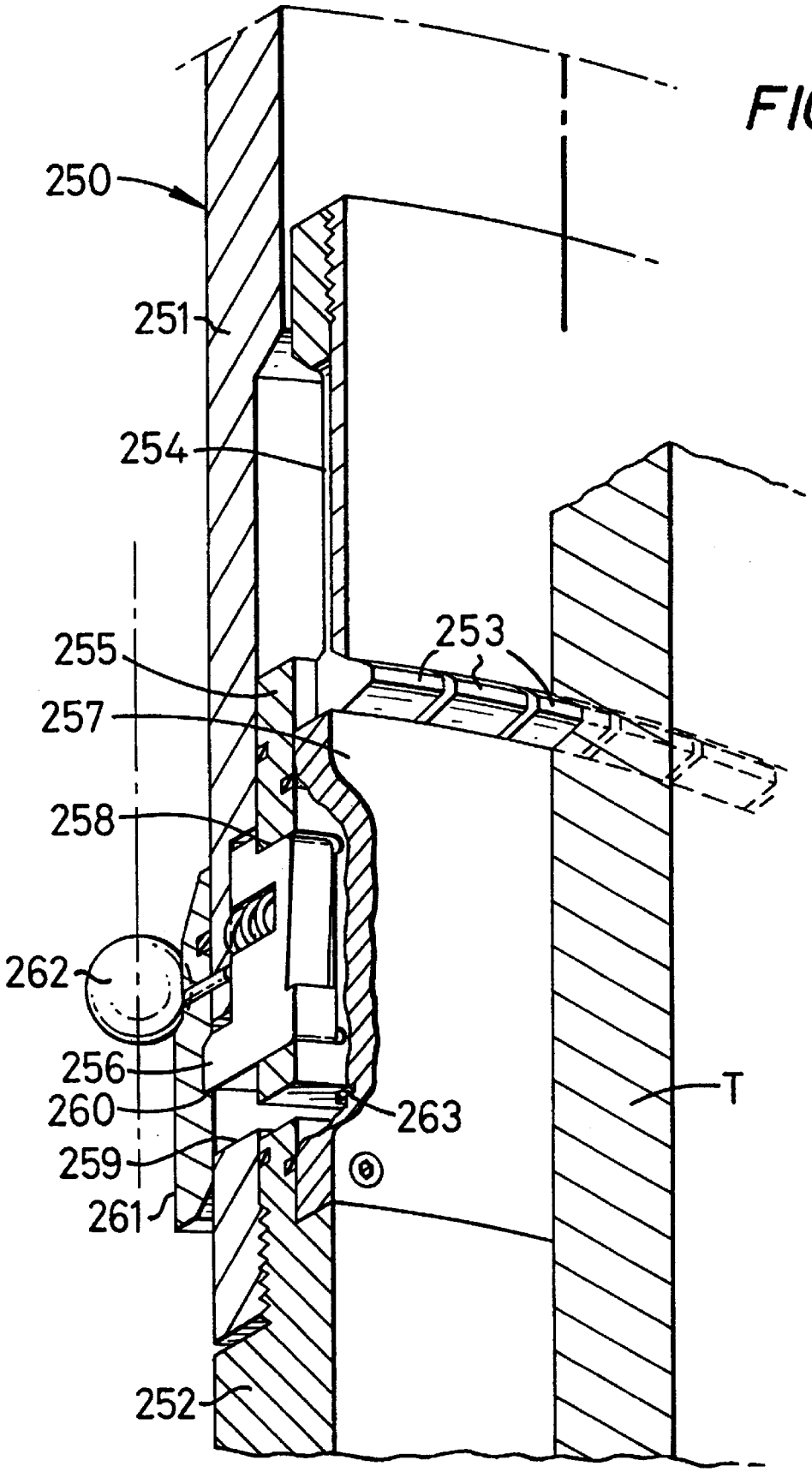
FIG. 4 is a sketch of the bottom part of the release mechanism shown in FIG. 3.

Referring now to FIGS. 3 and 4 there is shown a releasing mechanism which is generally identified by the reference number 200.

The releasing mechanism 200 is generally similar to the releasing mechanism 100 shown in FIGS. 1 and 2 and parts having generally similar functions have been identified by similar reference numbers in the "200" series. The only significant differences are that the vanes 204 are glued and bolted to the cylinder 203, and the first member 201 is disposed inside the second member 202.

The second member 202 comprises an intermediate section 226 which abuts a release section 227 integral with the first member 201.

In use, after the tool has been set an anti-clockwise turning movement is applied to the first member 201. This causes the first member 201 to rotate slowly anti-clockwise relative to the second member 202.

The release section 227 rotates with the first member 201 and eventually comes to rest in a position where the projection 228 lies in alignment with slot 229. If the tool string is lowered the release section 227 will move downwardly into the slot 229 and this movement can be used to activate a latch to release the tool from the intermediate section 226. The whole arrangement shown in FIG. 3 can then be withdrawn from the bore hole.

FIG. 4 shows a latch assembly, which co-operates with the arrangement shown in FIG. 3.

In particular, the latch assembly, which is generally identified by reference numeral 250 comprises a main body comprising cylindrical portions 251 and 252. The cylindrical portion 251 is attached to the bottom of the first member 201.

A latch comprising a plurality of collects 253 is disposed on fingers 254 which are connection to the intermediate section 226 by a connector plate indicated in chain-dotted lines. The fingers 254 are biased inwardly against a plate 255 which is slidably disposed on the cylindrical portion 251 and retained in position by a cover plate 257 which is attached to the cylindrical portion 252. A "T" dog 256 is slidably mounted on the cylindrical portion 251 and extends the full length of a slot 258 cut in the plate 255. The head of the "T" dog 256 projects through a slot 259 in the cylindrical portion 251 and engages a recess 260 in a ball valve seat 261 which is slidably mounted in the cylindrical portion 251. The ball valve seat 261, "T" dog 256 and plate 255 are prevented from travelling downwardly by a shear pin 263 mounted on the cover plate 257.

In use a tool "T" having an internal groove is placed with the collects 253 projecting into the internal groove. This prevents separation of the tool "T".

When it is desired to release the tool "T" an attempt is first made to actuate the latch assembly 250 via its primary release mechanism. This involves dropping a ball 262 down the tool string. The ball 262 should come to rest on the ball valve seat 261. Fluid is then pumped down the tool string. This should cause a shear pin to fail and the ball valve seat 261 to move downwardly in the cylindrical portion 251 entraining the "T"-dog 256 and the plate 255. This downward movement should fracture shear ring 263.

When the plate 255 has moved sufficiently downwardly the collects 253 are unrestrained and subsequent upward movement on the tool string will release the tool.

If the primary release fails for any reason recourse is made to the release mechanism in FIG. 3. In particular a left hand torque of about 3500 ft/lbs is applied to the tool string for about 30 seconds. As described above this brings the projection 228 on the release section 227 into alignment with the slot 229.

When the tool string is lowered relative to the slot 229 this movement is transferred to the latch assembly 250 7s0 that whilst the collects 253 and the fingers 254 remain in the same place the cylindrical portions 251 and 252, the ball valve seal 261, the "T"-dog 256, the plate 255 and the cover plate 257 all move downwardly until the plate 255 no longer supports the collects 253. In this connection it should be noted that the intermediate section 226 of the second member 202 is connected to the lower section 264 of the second member 202 via a tongue and groove connection 265 which enables the lower section 264 to move axially with the first member 201 relative to the intermediate section 226.

When the tool string is raised it separates from the tool bringing all the parts shown in FIGS. 2 and 3 to the surface with the exception of the tool "T".

One of the problems of the embodiments shown in FIGS. 1 to 4 is to damp the movement between the first member 101, 201 and the second member 102, 202 sufficiently. The embodiment shown in FIG. 5 achieves this.

Figure 5:
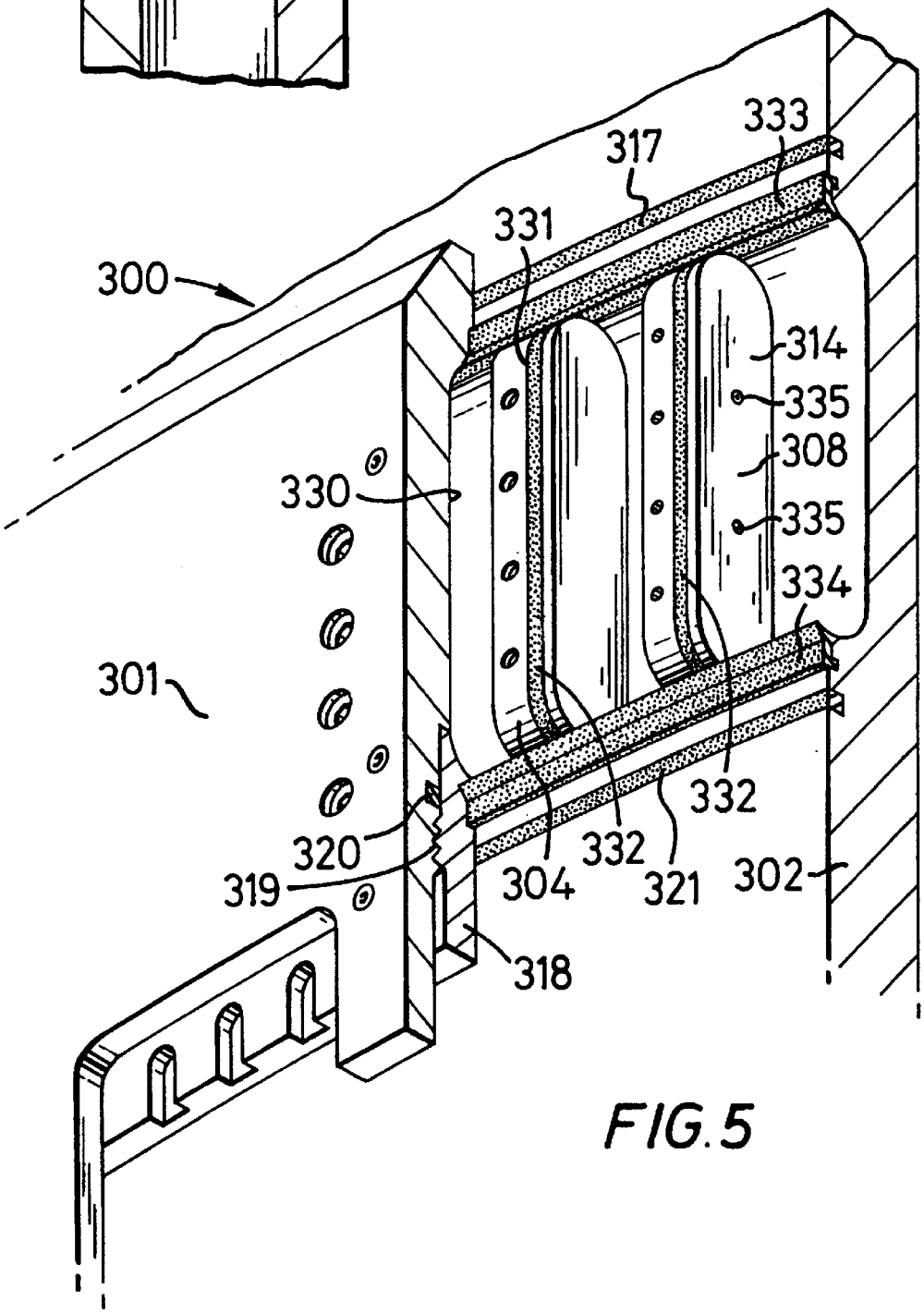
FIG. 5 is a sketch, partly in section and partly cut-away, of part of a third embodiment of a release mechanism according to the present invention during assembly.

In particular FIG. 5 shows part of a release mechanism which is generally identified by the reference numeral 300. The release mechanism 300 comprises a first member 301 which can be connected to a tool string and a latch. The release mechanism 300 also comprises a second member 302.

The first member 301 comprises a cylinder 303 provided with a recess 330 which accommodates one half of a plurality of vanes alternate ones of which are bolted to the first member 301 and the remainder of which are bolted to the second member 302. In FIG. 5 vane 308 is shown bolted to the second member 302 whilst vane 304 is shown awaiting manipulation into position to be bolted to the first member 301 in recess 330.

Each vane 304, 308 comprises an elongate member with rounded ends and is provided with a peripheral recess 331 which extends around the entire outer perimeter of the vane and is provided with an "O"-ring seal 332.

The top of the second member 302 is provided with a circumferentially extending seal 317.

Figure 6:
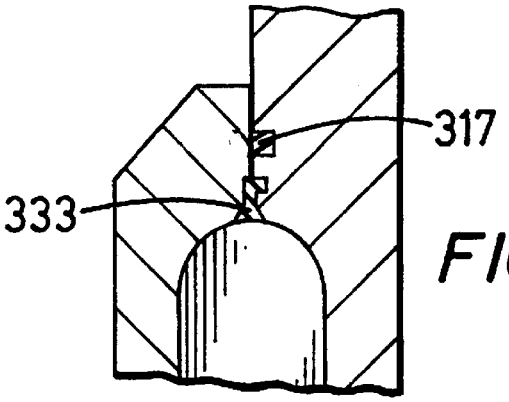
FIG. 6 shows, to an enlarged scale, a detail of FIG. 5.

Assembly of the release mechanism 300 is enabled by a removable section 318 which is threadedly connected to the first member 301 via threads 319 and is provided with a circumferentially extending "O"-ring 320 which acts between the removable section 318 and the first member 301 and the second member 302 is also provided with a circumferentially extending "O" ring which acts between first member 301 and the second member 302. Circumferentially extending gland seals 333 and 334 are also provided as shown to completely seal the recess. The gland seal 333 is better shown in the detail of FIG. 6. This arrangement has proved so successful that metering orifices 335 are provided in the vanes 308 attached to the second member 302 to control the flow ratio of hydraulic fluid therethrough.

The operation of the release mechanism is generally similar to the operation of the release mechanism described with reference to FIGS. 1 to 3 except that flow between the chambers is controlled by the orifices 335.

Whilst primary intended as a secondary release mechanism the present invention could also be used as a primary release mechanism.

Figure 7:
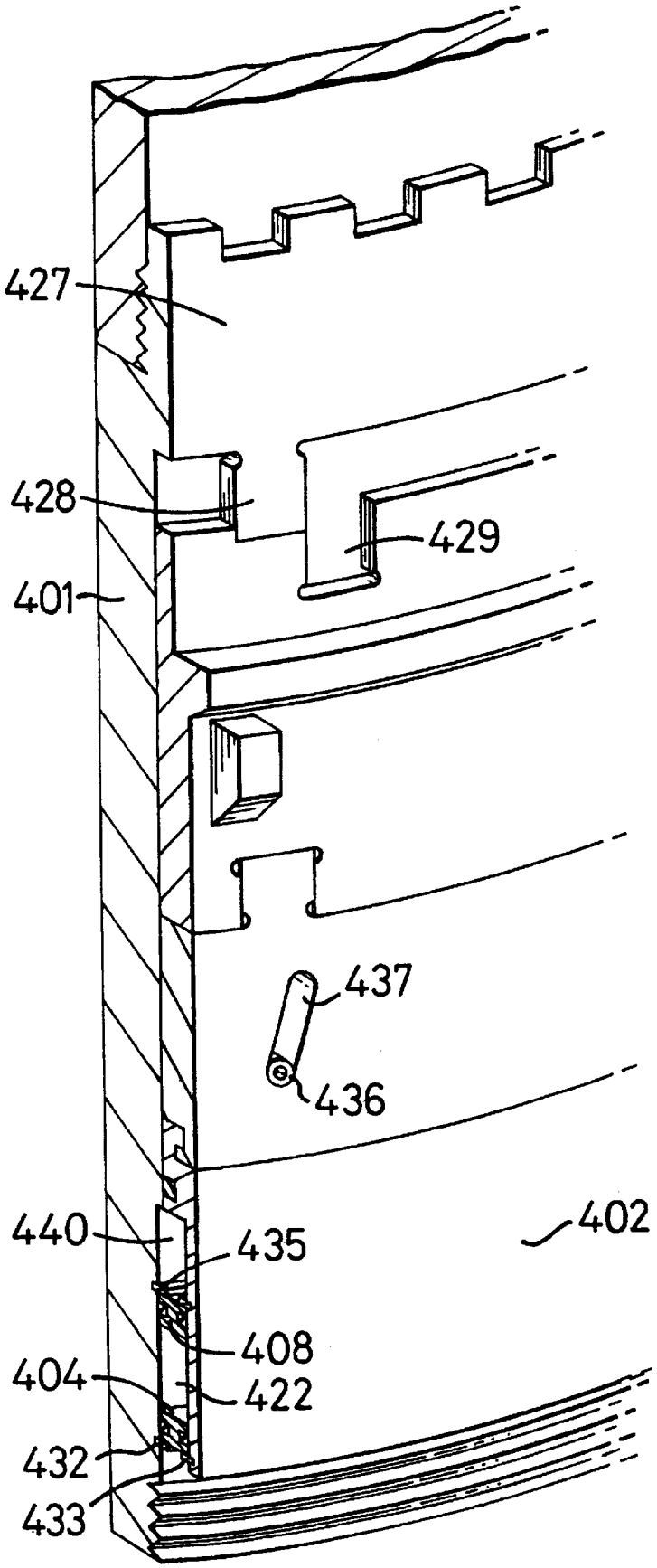
FIG. 7 is a sketch, partly in section, of part of a fourth embodiment of a release mechanism in accordance with the present invention.

Referring to FIG. 7 there is shown part of a release mechanism which is generally identified by the reference numeral 400. The release mechanism 400 is generally similar to the release mechanism 200 shown in FIGS. 3 and 4 and parts having similar functions have been identified by similar reference numerals in the "400" series.

The main difference in this embodiment is that relative rotation between the first member 401 and the second member 402 is generated by applying a prolonged axial upward force to the first member 401 after the tool (not shown) has been set. The axial upward force causes the first member 401 to move upwardly relative to the second member 402. This relative axial motion is translated into relative rotational motion via a pin 436 which is mounted on the first member 401 and is constrained for movement with respect to an inclined slot 437 formed in the second member 402.

In particular, an annular vane 404 is mounted on the first member 401 and is held in juxtaposition relative thereto by two circlips 432, 433 one of which is disposed to either side of the annular vane 404 and is let into a respective external groove in the outer circumference of the first member 401. Similarly, an annular vane 408 is mounted on the inner surface of the second member 402. Seals are provided between each annular vane 404, 408 and the first and second members 401, 402 as shown.

At the commencement of an operation the chamber 422 between the annular vanes 404, 408 is filled with hydraulic fluid which is retained in position by a light spring acting on a check valve mounted on the annular vane 408.

In operation, after the tool (not shown) has been set and the primarily release mechanism has failed upward pressure is applied to the tool string and then to the first member 401. This causes hydraulic fluid to flow out of chamber 422 into chamber 440. The action of the pin 436 moving in the slot 437 causes the first member 401 to rotate relative to the second member 402 until the projection 428 comes into alignment with the slot 429. The rate at which this occurs is controlled by the rate at which hydraulic fluid is permitted to move from chamber 422 to chamber 440.

When the tool string is subsequently lowered the projection 428 enters the slot 429 and the relative movement between the first member 401 and the intermediate section 426 is used to release the latch as described above with reference to FIGS. 3 and 4.

We claim:

1. A release mechanism (100; 200; 300; 400) for releasing a tool from a tool string during the construction, maintenance and repair of oil and gas wells, which release mechanism comprises a latch (250) for releasably securing said tool to said tool string, a first member (101; 201; 301; 401) connectable to said tool string and connected to said latch (250), and a second number (102; 202; 302; 402) connected to said latch (250), said first member being rotatable relative to said second member (101; 201; 301; 401) when said tool in set to a release position in which said latch (250) is released or can be release by displacement of said tool string into or out of said well, characterised in that said release mechanism comprises means to damp said relative rotation between said first member (101; 201; 301; 401) and said second member (102; 202; 302; 402).

2. A release mechanism as claimed in claim 1, wherein said means comprises at least one vane (104, 105, 106; 204; 304; 404) on said first member (101; 201; 301; 401), at least one vane (108, 209 110; 208; 308; 408) on said second member (102; 202; 302; 402) and hydraulic fluid therebetween.

3. A release mechanism as claimed in claim 2, wherein at least one of said vanes comprises a bar which is bolted to one of said first member and said second member.

4. A release mechanism as claimed in claim 2, wherein at least on of said vanes (304; 308) is elongate and rounded at its ends.

5. A release mechanism as claimed in claim 2, wherein said vane (304; 308) is provided with an external circumferentially extending groove which can accommodate a resilient sealing member (334).

6. A release mechanism as claimed in claims 4 wherein said first member (301) and second member (302) are shaped to accommodate the vanes (304, 308) therebetween.

7. A release mechanism as claimed in claim 2, including a removable section (118; 218; 318) to facilitate assembly of said release mechanism.

8. A release mechanism as claimed in claim 2, including one or more seals (117, 120, 121; 217, 220, 221; 317A, 317B, 320, 321) to inhibit the flow of hydraulic fluid from said release mechanism.

9. A release mechanism as claimed in claim 2, including a seal (333, 334) at the juncture of said first member (301) and said second member (302) in a position where is also contacts said vanes (304, 308).

10. A release mechanism as claimed in claim 2, wherein at least one said vanes (308) in provided with an orifice (335) to control the degree of damping of said release mechanism.

11. A release mechanism as claimed in claim 2, provided with at least one port (125) for the introduction of hydraulic fluid into said release mechanism.

* * * * *